US005989770A

United States Patent [19]

Ugai et al.

[11] Patent Number: 5,989,770

[45] Date of Patent: Nov. 23, 1999

[54] PROCESS FOR PRODUCING TONER FOR DEVELOPING ELECTROSTATIC LATENT IMAGES

[75] Inventors: Toshiyuki Ugai, Toride; Satoshi Yasuda, Shizuoka-ken; Kazunori Kato, Mitaka, all of Japan

[73] Assignee: Canon Kabushiki Kaisha, Tokyo, Japan

[21] Appl. No.: 09/238,723

[22] Filed: Jan. 28, 1999

[30] Foreign Application Priority Data

Apr. 23, 1998 [JP] Japan ..... 10-112592

[51] Int. Cl.[6] ..... G03G 9/097

[52] U.S. Cl. ..... 430/137; 430/110

[58] Field of Search ..... 430/137

[56] References Cited

U.S. PATENT DOCUMENTS 5,480,755 1/1996 Uchiyama et al. ..... 430/106.6
5,532,098 7/1996 Ong ..... 430/110
5,571,654 11/1996 Ong ..... 430/110
5,856,055 1/1999 Ugai et al. ..... 430/137

FOREIGN PATENT DOCUMENTS 60-238846 11/1985 Japan ..... 430/137

*Primary Examiner*—Roland Martin
*Attorney, Agent, or Firm*—Fitzpatrick, Cella, Harper & Scinto

[57] ABSTRACT

A process for producing a toner for developing an electrostatic latent image. The process has the steps of dispersing in an aqueous medium having a pH of from 4.5 to 8.5 a polymerizable monomer composition containing at least a polymerizable vinyl monomer, a colorant, an organic metal compound, an aromatic carboxylic acid, a polyester resin having an acid value of from 5 mg·KOH/g to 50 mg·KOH/g, and a polymerization initiator, to form particles of the polymerizable monomer composition in the aqueous medium, and polymerizing the polymerizable vinyl monomer in the particles of the polymerizable monomer composition.

21 Claims, 1 Drawing Sheet

FIGURE
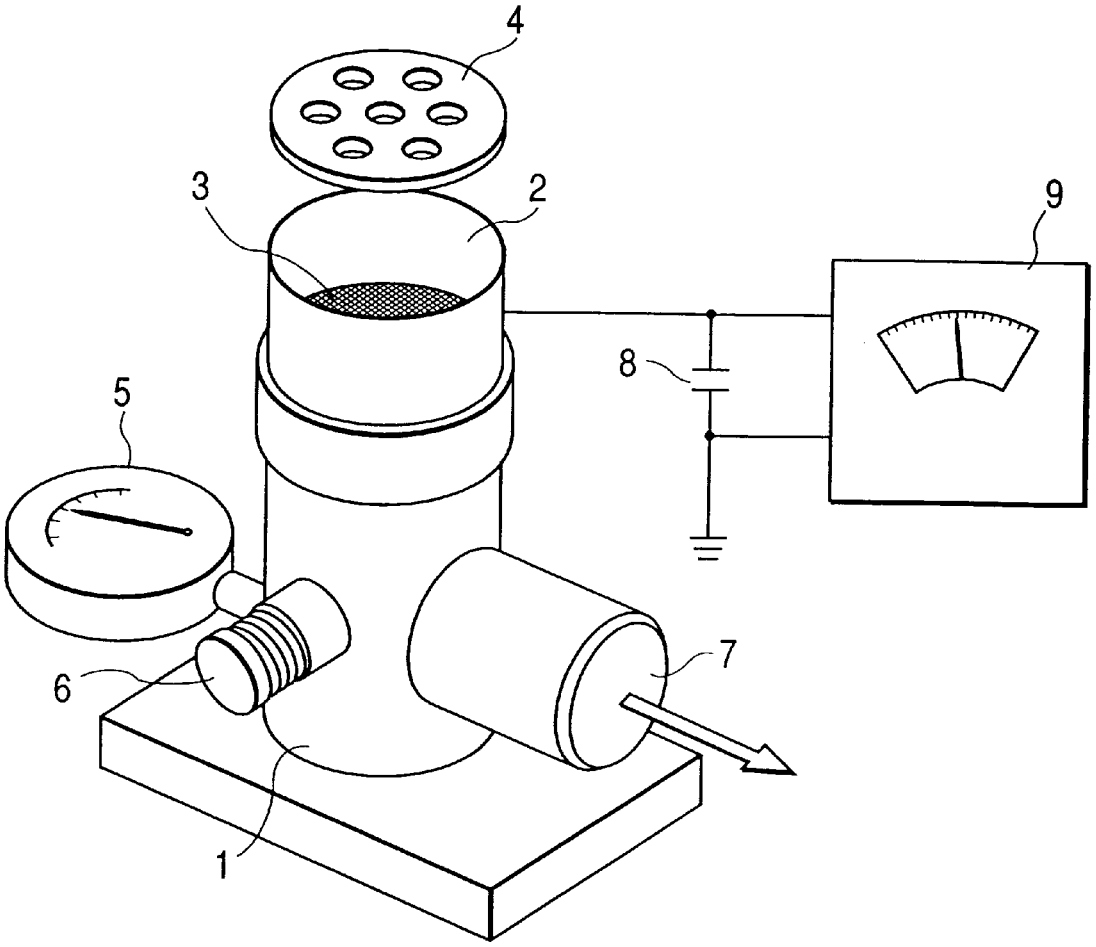

PROCESS FOR PRODUCING TONER FOR DEVELOPING ELECTROSTATIC LATENT IMAGES

BACKGROUND OF THE INVENTION

1. Field of the Invention

This invention relates to a process for producing a toner for developing electrostatic latent images which is used in electrophotography.

2. Related Background Art

A number of methods as disclosed in U.S. Pat. No. 2,297,691, etc. are known as electrophotography, which is commonly a process in which, using a photoconductive material, copies are obtained by forming an electrostatic latent image on a photosensitive member by various means, subsequently developing the latent image by the use of a toner to form a toner image, transferring the toner image to a recording medium such as paper as occasion calls, and thereafter fixing the toner image by the action of heat and/or pressure or solvent vapor. As methods for developing the electrostatic latent image by the use of toners or methods for fixing the toner image, a variety of methods have been proposed, and methods suited for the respective image forming processes are employed. Further in recent years, electrophotography is sought to achieve higher-speed copying and higher image quality.

Toners used for such purpose have been commonly produced by melt-kneading colorants comprising dyes or pigments, into thermoplastic resins to effect uniform dispersion, followed by pulverization using a fine grinding mill, and the pulverized product is classified using a classifier to produce toners having the desired particle diameters.

Reasonably good toners can be produced by such a production method, but there is a certain limit, i.e., a limit to the range in which toner materials are selected. For example, colorant-dispersed resin compositions must be brittle enough to be pulverizable with ease by means of a fine grinding mill economically available. However, such colorant-dispersed resin compositions made brittle in order to meet these requirements tend to result in a broad particle size distribution of the particles formed when actually pulverized at a high speed, causing especially a problem that fine particles tend to be produced in a relatively large proportion. Moreover, such highly brittle materials tend to be further finely pulverized or powdered when used for the development in copying machines or the like. Also, in this method, it is difficult to uniformly disperse solid fine particles of colorants and the like in the resin, and toners may cause an increase in fog, a decrease in image density and a lowering of color mixing properties or transparency of toners, depending on the degree of such dispersion. Accordingly, care must well be taken when colorants are dispersed. Also, colorants may come bare to rupture sections of pulverized particles, and may cause fluctuations in developing performance of toners.

Meanwhile, in order to overcome the problems of the toners produced by such pulverization, toners produced by suspension polymerization are proposed as disclosed in Japanese Patent Publications No. 36-10231, No. 43-10799 and No. 51-14895. In the production of toners by suspension polymerization, a polymerizable monomer, a colorant and a polymerization initiator, and also optionally a cross-linking agent, a charge control agent and other additives are uniformly dissolved or dispersed to form a polymerizable monomer composition. Thereafter, this polymerizable monomer composition is dispersed in a continuous phase containing a dispersion stabilizer, e.g., in an aqueous medium, by means of a suitable agitator, and is subjected simultaneously to polymerization reaction to obtain toner particles having the desired particle diameters.

Since this method has no step of pulverization, the toner particles are not required to be brittle, and hence soft materials can be used as the resin. Also, colorants may hardly come bare to the surfaces of toner particles, and hence the toners can have a uniform triboelectric charging performance. This method has such advantages. Since also the toners obtained have a relatively sharp particle size distribution, the step of classification can be omitted, or, even when classified, toners can be obtained in a high yield. The method also has the advantage that, since a low-softening substance as a release agent can be encapsulated in toner particles in a large quantity, the toners obtained have a superior anti-offset properties.

As examples where polymerization toners are used, it is proposed in Japanese Patent Application Laid-open No. 5-19662 to use secondary toner particles obtained by fusing primary polymerization particles; in Japanese Patent Application Laid-open No. 4-296766 to use a polymerization toner that transmits the light to which the photosensitive member is exposed; and in Japanese Patent Application Laid-open No. 5-188637 to use a toner specified in its volume-average particle diameter, number-average particle diameter, charge quantity of toner, projected-image area ratio of toner and BET specific surface area of toner. These, however, have not been well satisfactory.

Toners like the polymerization toners, having spherical particles and smooth particle surfaces, have small points of contact with charging members because of such features, and may cause problems of a lowering of charging performance and, in an environment of high humidity, a great lowering of charging performance. In order to solve these problems, it has been required for such toners to be more improved in charging performance than conventional toners.

Conventionally, in order to make a toner hold electric charges, it is possible to utilize the triboelectric chargeability of a resin which is a component of the toner. In this method, however, the toner has so low a charging performance that images obtained by development tend to fog and be unsharp. Accordingly, in order to impart the desired triboelectric charging performance to the toner, it is common to add a dye or pigment capable of imparting chargeability and further add a charge control agent.

Toners containing a charge control agent tend to contaminate toner carrying members such as developing sleeves, and hence the quantity of triboelectricity decreases with an increase in the number of sheets during copying to tend to cause a decrease in image density. Some charge control agents also have an insufficient quantity of triboelectricity and tend to be affected by temperature and humidity, tending to cause variations of image density which occur with environmental variations. Some charge control agents also have a poor dispersibility in resins, and hence tones making use of such charge control agents tend to have a non-uniform quantity of triboelectricity between toner particles, tending to cause fog. Some charge control agents still also have so poor a storage stability that the quantity of triboelectricity tends to decrease during long-term storage.

In polymerization toners, when materials are granulated in an aqueous medium, charge control agents tend to affect the system adversely. For example, problems may arise such that pigments are not dispersed well or that charge control agents dissolve partly to cause fine particles. In particular, formation of very fine particles such as emulsion particles causes contamination of charging members and great damage of toner performance, e.g., inhibition of charging performance of the toners.

Nowadays, charge control agents known in the present technical field include, as negative charge control agents, metal complexes of monoazo dyes, metal complexes of salicylic acid, naphthoic acid or dicarboxylic acids, copper phthalocyanine pigments, and resins containing acid components. Known as positive charge control agents are nigrosine dyes, azine dyes, triphenylmethane dyes, quaternary ammonium salts, and resins having a quaternary ammonium salt in the side chain.

Of these, various metal complexes are proposed as negative charge control agents, as disclosed in Japanese Patent Publications No. 43-17955 and No. 55-42752, Japanese Patent Application Laid-open No. 61-155464, Japanese Patent Publication No. 63-1994 and so froth. These certainly exhibit good chargeability, but, according to studies made by the present inventors, it can not be said that they are satisfactory when used in polymerization toners. Thus, it has been sought to make an improvement.

SUMMARY OF THE INVENTION

An object of the present invention is to provide a process for producing a toner for developing an electrostatic latent image which process has solved the problems discussed above.

Another object of the present invention is to provide a process for producing a toner for developing an electrostatic latent image which toner has a good chargeability in every environment, can form high-quality images and can be free from contamination of charging members.

Still another object of the present invention is to provide a process for producing a toner for developing an electrostatic latent image which toner has a good transfer performance.

A further object of the present invention is to provide a process for producing a toner for developing an electrostatic latent image which toner has a very sharp particle size distribution and contains less fine particles.

To achieve the above objects, the present invention provides a process for producing a toner for developing an electrostatic latent image; the process comprising the steps of;

dispersing in an aqueous medium having a pH of from 4.5 to 8.5 a polymerizable monomer composition containing at least a polymerizable vinyl monomer, a colorant, an organic metal compound, an aromatic carboxylic acid, a polyester resin having an acid value of from 5 mg·KOH/g to 50 mg·KOH/g, and a polymerization initiator, to form particles of the polymerizable monomer composition in the aqueous medium; and polymerizing the polymerizable vinyl monomer in the particles of the polymerizable monomer composition.

BRIEF DESCRIPTION OF THE INVENTION

FIGURE illustrates a device for measuring the quantity of triboelectricity of toner.

DESCRIPTION OF THE PREFERRED EMBODIMENTS

As a result of extensive studies, the present inventors have discovered that, in a polymerization toner containing a specific polyester resin, an organic metal compound and an aromatic carboxylic acid, a toner having a very sharp particle size distribution, free from formation of fine particles, achievable of good charging performance in every environment and having a good transfer performance can be obtained when particles of a polymerizable monomer composition are formed in an aqueous medium having a pH of from 4.5 to 8.5 to make polymerization.

As a result of extensive studies, the present inventors have concluded that, in the polymerization toner, its charging performance in every environment can be improved when the organic metal compound and the aromatic carboxylic acid are incorporated simultaneously as charge control agents.

In general, toners making use of metal compounds of organic acids used as charge control agents exhibit a relatively high charging performance in some cases, but show a decrease in charge quantity in an environment of high humidity and shows a lowering of charging rate in an environment of low humidity.

This is presumed to be caused by adsorption and desorption of water content around the metal. It is presumed that in the environment of high humidity the charge quantity decreases because of an increase in the amount of water adsorbed on the metal compound, and in the environment of low humidity the amount of water adsorbed in the metal compound decreases to make resistance higher, resulting in a lowering of charging rate.

Studies made by the present inventors have revealed that the incorporation of the aromatic carboxylic acid into polymerization toner in addition to the organic metal compound can prevent the charge quantity from decreasing in the environment of high humidity and prevent the charging rate from lowering in the environment of low humidity.

The reason therefor is unclear, and is presumed as follows: The aromatic carboxylic acid present together so acts as to be electrostatically stable and combine with, or become present in the vicinity of, the metal compound, so that the adsorption of water on the metal compound is blocked.

Among aromatic carboxylic acids, those considered to have negative electric charges in a low density on the carboxyl group oxygen as in hydroxycarboxylic acids may be used. In such a case, a high charge quantity can be attained even in the environment of high humidity. With regard to this, it is presumed that, when they have negative electric charges in a low density on the carboxyl group oxygen, the density of electrons on the metal atom becomes not so high even though the carboxylic acid combines with the metal, so that the metal compound can have a high negative chargeability.

According to studies made by the present inventors, the organic acid that constitutes the organic metal compound may particularly preferably be an aromatic hydroxycarboxylic acid. This is preferable because a stable charge quantity can be attained.

The incorporation of the organic metal compound and aromatic carboxylic acid into the polymerizable monomer composition can ensure the charging performance required as toners. However, it has become clear that, when toner particles are formed in an aqueous medium, fine particles of 2 $\mu$m or smaller tend to be formed in a large number in addition to the toner particles having the desired particle diameter, and, when a developer containing such fine particles is used, the charging member is contaminated to cause a problem of faulty charging during long-term service.

Such fine particles may also make the toner have a poor fluidity to cause a bad influence on transfer performance.

The present inventors have solved this problem by controlling the pH of the aqueous medium. More specifically, the particles of a polymerizable monomer composition are formed in the aqueous medium having a pH of from 4.5 to 8.5. This has made it possible to obtain a toner having a very sharp particle size distribution and having been improved greatly in charging performance in every environment, without formation of fine particles which may contaminate charging members and make transfer performance poor.

The reason therefor is unclear, and is presumed as follows: Since in the present invention granulation is carried out in the aqueous medium having a pH of from 4.5 to 8.5, the organic metal compound and aromatic carboxylic acid are restrained from dissolving out in water. If the organic metal compound and aromatic carboxylic acid dissolve out in water, the organic metal compound and aromatic carboxylic acid having dissolved out may function as surface-active agents to cause the formation of fine particles. However, in the toner production process of the present invention, these are restrained from dissolving out, and hence the fine particles are also restrained from being formed.

The aqueous medium has a pH of from 4.5 to 8.5, and may preferably have a pH of from 4.5 to 7.0, and more preferably from 4.5 to 6.0.

So long as it has a pH of 4.5 or above, the particles in the aqueous medium can be stably present, and hence the particles can be restrained from agglomeration or coalescence. If it has a pH above 8.5, it may be impossible to attain the very sharp particle size distribution and also difficult to restrain the fine particles from being formed.

The pH may be adjusted by a method in which an acid such as hydrochloric acid, sulfuric acid, nitric acid or phosphoric acid is added immediately before the granulation of polymerization particles, or a method in which, when a dispersion stabilizer is formed in a dispersion medium, the acid is added to the materials before it is formed, to attain the intended pH, either method may be used.

For example, when tricalcium phosphate is used as the dispersion stabilizer, the acid may be added in an appropriate quantity before an aqueous calcium chloride solution is mixed in an aqueous sodium phosphate solution, and thereafter the aqueous calcium chloride solution is added to attain the intended pH. Such a method may preferably be used.

As the aromatic carboxylic acid used in the present invention, benzoic acid, naphthoic acid and derivatives thereof may be used. In particular, an aromatic hydroxycarboxylic acid is preferred. For example, it includes salicylic acid, alkyl salicylic acids having an alkyl group having 5 or less carbon atoms, and 3,5-dialkylsalicylic acids; 3,5-dialkylsalicylic acids are particularly preferred. As the alkyl group, a t-butyl group is most preferred.

As other compounds, 2-hydroxy-3-naphthoic acid, alkyl-2-hydroxy-3-naphthoic acids having an alkyl group having 5 or less carbon atoms, and 5,6,7,8-tetrahalogen-2-hydroxy-3-naphthoic acids may be used.

The aromatic carboxylic acid may be used in an amount of from 0.01 to 1.5 parts by weight, preferably from 0.02 to 1.3 parts by weight, and particularly preferably from 0.05 to 1.1 parts by weight, based on 100 parts by weight of the polymerizable monomer.

As the organic metal compound, aluminum, zinc, chromium, cobalt, nickel, copper or iron compounds of the above aromatic hydroxy acid may preferably be used.

Specific organic metal compounds are exemplified by the following compounds.

Exemplary compound (1)

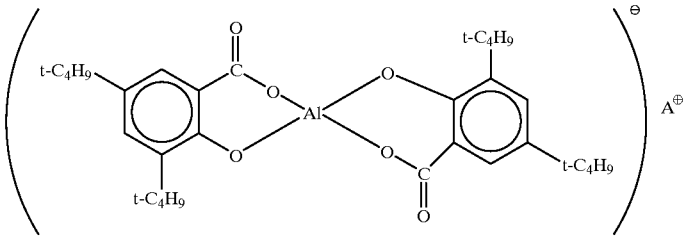

(wherein A represents a hydrogen atom, an alkali metal or an alkaline earth metal.)

Exemplary compound (2)

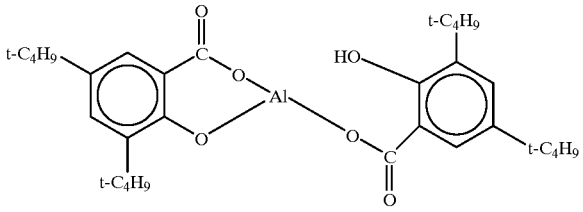

-continued

Exemplary compound (3)

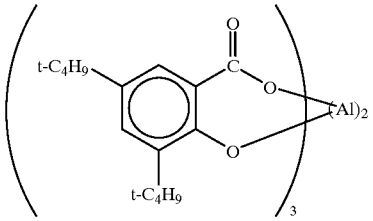

Exemplary compound (4)

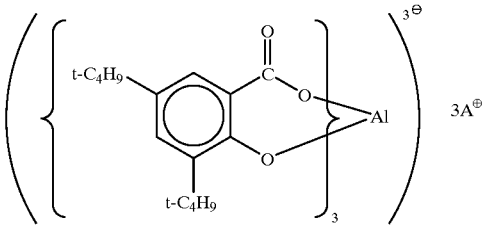

Exemplary compound (5)

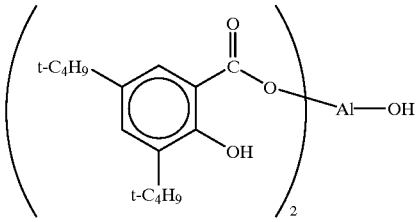

Exemplary compound (6)

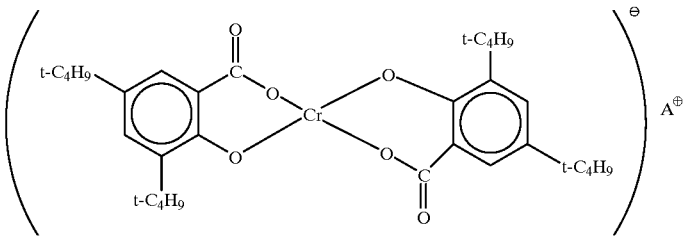

Exemplary compound (7)

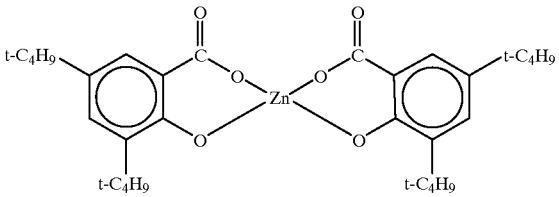

Exemplary compound (8)

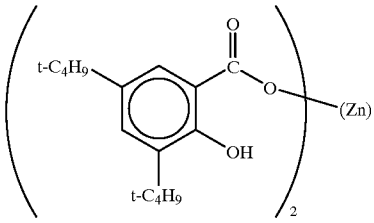

The organic metal compound may be used in an amount of from 0.45 to 13.5 parts by weight, and preferably from 0.5 to 10.0 parts by weight, based on 100 parts by weight of the polymerizable monomer.

The present inventors have also discovered that the charging rate can be further improved by carrying out polymerization with addition of, as a resin having a polarity, an anionic polymer polyester resin to the polymerizable monomer composition.

The polyester resin is a resin having a high water absorption because its carbonyl group serves as a water pickup site, and also exhibits a negative chargeability with quick rise. In addition, since it is a polar resin, when particles are formed in the aqueous medium to produce the polymerization toner, it localizes toward toner particle surfaces to become present in the manner it encapsulate other component materials. Toner particles thus formed assume what is called the core/shell structure and exhibit a stable triboelectric chargeability.

The polyester resin used in the present invention has an acid value of from 5 to 50 mg·KOH/g, preferably from 5 to 35 mg·KOH/g, and more preferably from 5 to 30 mg·KOH/g. Such a resin brings about good results.

If the polyester resin has an acid value less than 5 mg·KOH/g, it can not localize well toward the toner particle surfaces to make charging not rise well. If it has an acid value more than 50 mg·KOH/g, it can not dissolve well in the polymerizable monomer to make it impossible to achieve a good granulation performance.

The polyester resin used in the present invention may preferably be constituted of from 45 to 55 mol % of an alcohol component and from 55 to 45 mol % of an acid component in the whole components.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following formula:

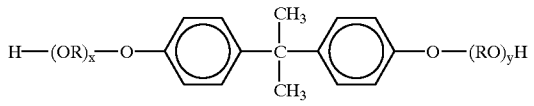

wherein R represents an ethylene group or a propylene group, x and y are each an integer of 1 or more, and an average value of x+y is 2 to 10;
and a diol represented by the following formula:

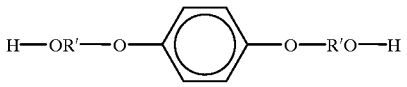

wherein R' represents

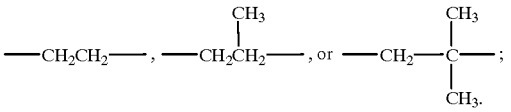

As a dibasic carboxylic acid component which comprises at least 50 mol % in the total acid components, it may include benzene dicarboxylic acids and anhydrides thereof, such as phthalic acid, terephthalic acid, isophthalic acid and phthalic anhydride; alkyldicarboxylic acids such as succinic acid, adipic acid, sebacic acid and azelaic acid, and anhydrides thereof, and succinic acid substituted with an alkyl group or alkenyl group having 6 to 18 carbon atoms, or anhydrides thereof; and unsaturated dicarboxylic acids such as fumaric acid, maleic acid, citraconic acid and itaconic acid, or anhydrides thereof.

The alcohol component may further include polyhydric alcohols such as glycerol, pentaerythritol, sorbitol, sorbitan, and oxyalkylene ethers of novolak type phenol resin. As the acid component, it may include polycarboxylic acids such as trimellitic acid, pyromellitic acid and benzophenonetetracarboxylic acid, or anhydrides thereof.

A preferred alcohol component of the polyester resin is the bisphenol derivative represented by the above formula. As a preferred acid component, it may include phthalic acid, terephthalic acid and isophthalic acid, or anhydrides thereof; succinic acid and n-dodecenylsuccinic acid, or anhydrides thereof; and dicarboxylic acids such as fumaric acid, maleic acid and maleic anhydride. As a cross-linking component, it may include trimellitic anhydride, benzophenonetetracarboxylic acid, pentaerythritol, and oxyalkylene ethers of novolak type phenol resins.

The polyester resin may be added in an amount of from 0.1 to 15% by weight, preferably from 0.5 to 12% by weight, and more preferably from 1 to 10% by weight, based on the weight of the polymerizable monomer used. If the polyester resin is added in an amount less than 0.1% by weight based on the weight of the polymerizable monomer, it may be difficult to obtain the effect of improving the charging rate. If it is added in an amount more than 15% by weight based on the weight of the polymerizable monomer, the colorant may be dispersed poorly to tend to result in a poor granulation performance.

The polyester resin used in the present invention may also preferably have a weight-average molecular weight (Mw) of from 5,000 to 50,000, and more preferably from 5,000 to 35,000.

If the polyester resin has a weight-average molecular weight less than 5,000, a low-molecular weight polyester resin tends to localize to toner particle surfaces, and hence the toner obtained tends to have a poor anti-blocking properties. If it has a weight-average molecular weight more than 50,000, the colorant may be dispersed poorly to tend to result in a poor granulation performance.

In the present invention, in combination with the above specific polyester resin, an additional polar polymer (resin having a polar group) may be added in the polymerizable monomer composition to carry out polymerization. Such an additional polar polymer usable in the present invention are exemplified by below.

As a cationic polymer, it may include polymers of nitrogen-containing monomers such as dimethylaminoethyl methacrylate and diethylaminoethyl methacrylate, or copolymers of any of these nitrogen-containing monomers with styrene monomers or unsaturated carboxylate monomers.

As an anionic polymer, polyester resins are most preferred, and besides it may include homopolymers or copolymers of monomers including nitrile type monomers such as acrylonitrile, halogen type monomers such as vinyl chloride, unsaturated carboxylic acid monomers such as acrylic acid and methacrylic acid, unsaturated dibasic acid monomers, unsaturated dibasic acid anhydride monomers and nitro type monomers, or copolymers of these monomers with styrene type monomers.

Such an additional polar polymer may preferably be used in an amount of from 0.1 to 15% by weight, more preferably from 0.5 to 12% by weight, and still more preferably from 1 to 10% by weight, based on the weight of the polymerizable monomer.

In the present invention, a wax may be incorporated in order to improve fixing performance and anti-offset properties of the toner.

Waxes usable in the present invention may include hydrocarbon waxes, including, e.g., low-molecular-weight alkylene polymers obtained by radical polymerization of alkylenes under a high pressure, low-molecular-weight alkylene polymers obtained by polymerization of alkylenes in the presence of a Ziegler catalyst under a low pressure, low-molecular-weight alkylene polymers obtained by thermal decomposition of high-molecular-weight alkylene polymers, and low-molecular-weight polymethylene waxes obtained by hydrogenation of distillation residues of hydrocarbon polymers obtained by the Arge process from a synthetic gas containing carbon monoxide and hydrogen. Of these hydrocarbon waxes, hydrocarbon waxes obtained by extraction fractionation of specific components are particularly suitable. Preferred are those obtained by removing low-molecular-weight components from waxes by a process such as press sweating, solvent fractionation, vacuum distillation or fractionation crystallization.

As a further additional wax, it may include microcrystalline wax, carnauba wax, sazole wax, paraffin wax and ester wax.

The wax may preferably be those having a number-average molecular weight (Mn) of from 500 to 1,200 and a weight-average molecular weight (Mw) of from 800 to 3,600 in terms of polyethylene. If the wax has a molecular weight smaller than the above range, poor blocking resistance and developing performance may result. If it has a molecular weight larger than the above range, it may be difficult to achieve good fixing performance and anti-offset properties.

The wax may preferably have a value of Mw/Mn of 5.0 or less, and more preferably 3.0 or less.

It is effective for the wax to be used in an amount of from 3 to 20 parts by weight, and preferably from 5 to 15 parts by weight based on 100 parts by weight of the binder resin.

The core/shell structure of the toner particles have can be confirmed by examining cross-sections of toner particles. Stated specifically, the cross-sectional structure of toner particles can be confirmed in the following way: Toner particles are well dispersed in a room temperature curing epoxy resin, followed by curing in an atmosphere of temperature of 40° C. for 2 days, and the cured product obtained is dyed with triruthenium tetraoxide optionally in combination with triosmium tetraoxide, thereafter samples are cut out in slices by means of a microtome having a diamond cutter to observe the sample using a transmission electron microscope (TEM). The toner particles obtained in Examples described later have been confirmed to have the core/shell structure.

The toner particles according to the present invention may preferably have a diameter of from 3 to 10 $\mu$m as weight-average particle diameter, and may preferably have a diameter of from 4 to 9 $\mu$m in order to make image quality higher.

An example of the toner production process of the present invention will be described below.

A polymerizable monomer composition comprising polymerizable monomers and added therein a colorant, a charge control agent, a polymerization initiator, the specific polyester resin and other additives, having been dissolved or dispersed uniformly by means of a homogenizer or an ultrasonic dispersion machine, is dispersed in an aqueous medium containing a dispersion stabilizer and having the pH of from 4.5 to 8.5, by means of a conventional stirrer, a homomixer or a homogenizer. Granulation is carried out preferably while controlling the agitation speed and time so that droplets of the monomer composition can have the desired toner particle size. After the granulation, agitation may be carried out to such an extent that the state of particles is maintained and the particles can be prevented from settling by the acton of the dispersion stabilizer. The polymerization may be carried out at a polymerization temperature set at 40° C. or above, usually from 50 to 90° C. At the latter half of the polymerization, the temperature may be raised, and also the aqueous medium may be removed in part from the reaction system at the latter half of the reaction or after the reaction has been completed, in order to remove unreacted polymerizable monomers, by-products and so forth. After the reaction has been completed, the toner particles formed are collected by washing and filtration, followed by drying. In this process (suspension polymerization), water may usually be used as a dispersion medium preferably in an amount of from 300 to 3,000 parts by weight based on 100 parts by weight of the polymerizable monomer composition.

A dispersion stabilizer used in the step of suspension polymerization in the present invention may include, as inorganic oxides, e.g., tricalcium phosphate, hydroxylapatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. As organic compounds, it may include, e.g., polyvinyl alcohol, gelatin, methyl cellulose, methyl hydroxypropyl cellulose, ethyl cellulose, carboxymethyl cellulose sodium salt, and starch. Any of these dispersion stabilizers may preferably be used in an amount of from 0.2 to 10 parts by weight based on 100 parts by weight of the polymerizable monomer.

As these dispersion stabilizers, those commercially available may be used as they are. In order to obtain dispersed particles having a fine and uniform particle size, however, fine particles of the inorganic compound may be formed in the dispersion medium under high-speed agitation. For example, in the case of tricalcium phosphate, an aqueous sodium phosphate solution and an aqueous calcium chloride solution may be mixed under high-speed agitation to obtain dispersion stabilizers preferable for the suspension polymerization.

The polymerizable monomer used in the toner production process of the present invention has at least a polymerizable vinyl monomer. The polymerizable vinyl monomer may include styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and monomers such as butadiene, isoprene, cyclohexene, acrylo- or methacrylonitrile and acrylic acid amide.

The polymerization initiator used when suspension polymerization is carried out in the present invention may include, e.g., azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

The polymerization initiator may usually be used in an amount of from 0.5 to 20% by weight based on the weight of the polymerizable monomers, which varies depending on the intended degree of polymerization. The polymerization initiator may a little vary in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may further be added.

As the colorant used in the toner production process of the present invention, carbon black, magnetic materials, and colorants toned in black by the use of yellow, magenta and cyan colorants shown below are used as black colorants.

As the yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147 and 168 are used preferably.

As the magenta colorant, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 146, 166, 169, 177, 184, 185, 202, 206, 220, 221 and 254 are particularly preferable.

As the cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

These colorants may be used alone, in the form of a mixture, or in the state of a solid solution. The colorant may preferably be used in an an amount of from 1 to 20 parts by weight based on 100 parts by weight of the polymerizable monomer.

Attention must be paid to polymerization inhibitory action or aqueous-phase transfer properties inherent in the colorants. The surfaces of colorants may preferably be modified, e.g., be subjected to hydrophobic treatment using materials free from polymerization inhibition. In particular, most dye type colorants and carbon black have such polymerization inhibitory action and hence care must be taken when used. A preferable method for the surface treatment of the dyes may include a method in which polymerizable monomers are polymerized previously in the presence of any of these dyes. The resulting colored polymer may be added to the polymerizable monomer composition. With regard to the carbon black, besides the same treatment as the above on the dyes, it may be treated with a material capable of reacting with surface functional groups of the carbon black, as exemplified by organopolysiloxane.

External additives usable in the present invention may include, e.g., oxides such as alumina, titanium oxide, silica, zirconium oxide and magnesium oxide, and besides silicon carbide, silicon nitride, boron nitride, aluminum nitride, magnesium carbonate and organosilicon compounds.

It is preferable for the above fine powder to have been subjected to hydrophobic treatment so that the toner can be less dependent on environment such as temperature and humidity and also the fine powder can be prevented from coming off toner particle surfaces. An agent for this hydrophobic treatment may include, e.g., coupling agents such as silane coupling agents, titanium coupling agents and aluminum coupling agents, and oils such as silicone oil, fluorine type oils and various modified oils.

Of these known external additives, silica, alumina, titanium oxide or double oxides thereof may preferably be selected in order to improve charging stability, developing performance, fluidity and storage stability. In particular, silica is preferred in view of an advantage that coalescence of primary particles can be controlled arbitrarily to a certain extent in accordance with starting materials or oxidation conditions such as temperature. Such silica includes what is called dry-process silica or fumed silica produced by vapor phase oxidation of silicon halides or alkoxides and what is called wet-process silica produced from alkoxides or water glass, either of which can be used. The dry-process silica is preferred, as having less silanol groups on the surface and inside and leaving no production residue such as $Na_2O$ and $SO_3^{2-}$. In the dry-process silica, it is also possible to use, in its production step, other metal halide such as aluminum chloride or titanium chloride together with the silicon halide to obtain a composite fine powder of silica with other metal oxide.

The external additive may preferably be added in an amount of from 0.1 to 3 parts by weight based on 100 parts by weight of the toner particles in order to make toner's charge quantity stable, to make its bulk density stable and to make its stability higher when left in an environment of high humidity. Any of these external additives may be used in combination of two or more. External additives which may preferably further additionally be used in combination will be described below.

In order to improve transfer performance and/or cleaning performance, inorganic or organic closely spherical fine particles having a primary particle diameter of 50 nm or larger (preferably having a specific surface area smaller than 50 $m^2/g$) may further be added. This is one of the preferred embodiments. For example, spherical silica particles, spherical polymethyl silsesquioxane particles and spherical resin particles may preferably be used.

Other additives may also be used which may include, e.g., lubricant powders such as Teflon powder, zinc stearate powder and polyvinylidene fluoride powder; abrasives such as cerium oxide powder, silicon carbide powder and strontium titanate powder; anti-cakinging agents such as titanium oxide powder and aluminum oxide powder; and conductivity-providing agents such as carbon black powder, zinc oxide powder and tin oxide powder. Reverse-polarity organic particles and inorganic particles may also be used in a small quantity as a developability improver.

The toner produced by the process of the present invention may also be incorporated with a magnetic material so that it can be used as a magnetic toner. In this case, the magnetic material may also serve as the colorant. In the present invention, the magnetic material contained in the magnetic toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having an average particle diameter of 2 $\mu$m or less, and preferably from 0.1 to 0.5 $\mu$m. The magnetic material may preferably be contained in the toner in an amount of from 20 to 200 parts by weight, and particularly preferably from 40 to 150 parts by weight, based on 100 parts by weight of the polymerizable monomer.

The magnetic material may preferably be those having a coercive force (Hc) of from 20 to 300 oersted, a saturation magnetization ($\sigma s$) of from 50 to 200 emu/g and a residual magnetization ($\sigma r$) of from 2 to 20 emu/g, as magnetic characteristics under application of 10 K oersted.

The toner produced by the process of the present invention can usually be used as a toner for one-component developers, or as a toner for two-component developers.

For example, as a one-component developer, in the case of a magnetic toner comprising toner particles incorporated with the magnetic material, there is a method in which the magnetic toner is transported and electrostatically charged, utilizing a developing sleeve provided internally with a magnet. When a non-magnetic toner containing no magnetic material is used, there is a method in which the toner is transported by charging it forcedly triboelectrically on a developing sleeve to cause it to adhere onto the sleeve, using a blade or a fur brush.

As for the instance where the toner is used as a two-component developer commonly used, a carrier is used together with the toner according to the present invention. There are no particular limitations on the carrier used. Principally, a carrier produced solely using iron, copper, zinc, nickel, cobalt, manganese or chromium element, a composite ferrite, or a carrier whose core particles are coated with resin may be used. The shape of carrier particles is also important in view of the advantage that the saturation magnetization and electrical resistivity can be controlled in wide range. For example, it is preferable to select spherical, flat or shapeless particles and also to control the microstructure of carrier particle surfaces, e.g., surface unevenness. As the resin-coated carrier, what is commonly used is a method in which the above inorganic oxide is fired and granulated to beforehand produce carrier core particles, which are thereafter coated with resin. From the meaning of decreasing the load of carrier to toner, it is also possible to use a method in which the inorganic oxide and the resin are kneaded, followed by pulverization and classification to obtain a low-density dispersed carrier, or a method for obtaining a polymerization carrier in which a kneaded product of an inorganic oxide and monomers is subjected directly to suspension polymerization in an aqueous medium to obtain a true-spherical dispersed carrier.

A coated carrier comprising carrier core particles coated with a coat material such as resin is particularly preferred. As a method for such coating, a coat material dissolved or suspended in a solvent may be coated to make it adhere to carrier particles, or the coat material is merely mixed in the form of a powder. Any of such conventional methods may be used.

The material to be coated on the carrier core particle surfaces may differ depending on toner materials. For example, it is suitable to use, alone or in combination, polytetrafluoroethylene, monochlorotrifluoroethylene copolymer, polyvinylidene fluoride, silicone resin, polyester resin, a metal compound of di-tert-butylsalicylic acid, styrene resin, acrylic resin, polyamide, polyvinyl butyral, Nigrosine, aminoacrylate resin, a basic dye or a lake compound thereof, fine silica powder and fine alumina powder, but not necessarily limited to these.

Usually, in the treatment, the above material may preferably be used in an amount of from 0.1 to 30 parts by weight, and more preferably from 0.5 to 20 parts by weight, in total based on 100 parts by weight of the carrier.

The carrier may preferably have an average particle diameter of from 10 to 100 $\mu$m, and more preferably from 20 to 50 $\mu$m.

As a particularly preferred embodiment, the carrier is a coated ferrite carrier comprising Cu—Zn—Fe three-component ferrite particles whose surfaces are coated with a mixture comprised of a combination of resins such as a fluorine resin and a styrene resin (e.g., a combination of polyvinylidene fluoride with styrene-methyl methacrylate resin, polytetrafluoro-ethylene with styrene-methyl methacrylate resin or a fluorine type copolymer with a styrene type copolymer, in a ratio of from 90:10 to 20:80, and preferably from 70:30 to 30:70) in a coating weight of from 0.01 to 5% by weight, and preferably from 0.1 to 1% by weight, containing 70% by weight or more of 250 mesh-pass and 400 mesh-on carrier particles and having the above average particle diameter. The fluorine type copolymer is exemplified by a vinylidene fluoride-tetrafluoroethylene copolymer (10:90 to 90:10) and the styrene type copolymer is exemplified by a styrene-2-ethylhexyl acrylate (20:80 to 80:20), a styrene-2-ethylhexyl acrylate-methyl methacrylate copolymer (20 to 60:5 to 30:10 to 50).

The above coated ferrite carrier has a sharp particle size distribution, can provide a triboelectric chargeability preferable for the toner according to the present invention, and also is effective for improving electrophotographic performances.

When the two-component developer is prepared by blending the toner according to the present invention and the carrier, good results can be obtained when they are blended in such a proportion that gives a toner concentration of from 2% by weight to 15% by weight, and preferably from 4% by weight to 13% by weight in the developer. If the toner concentration is less than 2% by weight, images tend to have a low density. If it is more than 15% by weight, fog and in-machine toner scatter may occur to tend to shorten the service life of the developer.

The carrier may preferably have the following magnetic properties. Magnetization intensity at 1,000 oersted ($\sigma_{1,000}$) after having been saturated magnetically is required to be from 30 to 300 emu/cm$^3$. In order to achieve a higher image quality, it is more preferably from 100 to 250 emu/cm$^3$. If it is greater than 300 emu/cm$^3$, it becomes difficult to obtain toner images with a high image quality. If it is less than 30 emu/cm$^3$, carrier adhesion tends to occur because of a decrease in magnetic restraint force.

The values of physical properties of the toner used in the present invention are measured by methods described below.

(1) Measurement of particle size distribution:

Measured using a Coulter counter Model TA-II or Coulter Multisizer (manufactured by Coulter Electronics, Inc.). An interface (manufactured by Nikkaki k.k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of 2 $\mu$m or larger by means of the above Coulter counter Model TA-II, using an aperture of 100 $\mu$m as its aperture. Then the volume-based weight-average particle diameter (D4) and the number-based length-average particle diameter (D1) are determined.

Incidentally, in the present invention, the value of D4/D1 is also calculated, which indicates that, the closer to 1 the value is, the sharper the particle size distribution is.

(2) Measurement of the number of 2 $\mu$m or smaller diameter particles:

A flow type particle image analyzer FPIA-1000, manufactured by Toa Iyou Denshi K.K., is used as a measuring device. In 10 ml of water in which 0.1 mg of a nonionic surface-active agent stands dissolved, 5 mg of toner is dispersed to prepare a dispersion. The dispersion is irradiated by ultrasonic waves (20 kHz, 50 W) for 5 minutes, and the measurement is made with the flow type particle image analyzer to obtain the percent (%) by number of particles having particle diameters of from 0.6 to 2.0 μm.

(3) Measurement of acid value:

The acid value of the polyester resin in the present invention is determined in the following way.

Into a 200 ml Erlenmeyer flask, 2 to 10 g of a sample is weighed and put, followed by addition of about 50 ml of a 30:70 mixed solvent of methanol and toluene to dissolve the sample. If solubility is poor, acetone may be added in a small quantity. Then, using a 0.1% by weight of mixed reagent of Bromothymol Blue and Phenol Red, titration is made in 0.1 M potassium hydroxide-ethanol solution standardized previously, and the acid value is calculated from the consumption of the potassium hydroxide-ethanol solution according the following expression.

$$\text{Acid value (mg·KOH/g)}=\text{KOH (ml)}\times f\times 56.1/\text{sample weight (g)}$$

wherein f represents a factor of the 0.1 M potassium hydroxide-ethanol solution.

In the present invention, an average of measurement made twice by the above method is indicated as the acid value.

(4) Measurement of weight-average molecular weight of polyester resin:

In the present invention, the weight-average molecular weight is measured by gel permeation chromatography (GPC). A specific method for measurement is shown below.

Columns are stabilized in a heat chamber of 40° C. To the columns kept at this temperature, THF (tetrahydrofuran) as a solvent is flowed at a flow rate of 1 ml per minute, and about 100 μl of THF sample solution is injected thereinto to make measurement. In measuring the molecular weight of the sample, the molecular weight distribution ascribed to the sample is calculated from the relationship between the logarithmic value and number of count of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Toso Co., Ltd. or Showa Denko KK., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H ($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

The sample is prepared in the following way: The sample is put in tetrahydrofuran (THF), and is left for several hours, followed by thorough shaking so as to be well mixed with the THF (until coalescent matters of the sample has disappeared), which is further left for at least 12 hours. At this time, the sample is so left as to stand in THF for at least 24 hours in total. Thereafter, the solution having been passed through a sample-treating filter (pore size: 0.45 to 0.5 μm; for example, MAISHORI DISK H-25-5, available from Toso Co., Ltd. or EKIKURO DISK 25CR, available from German Science Japan, Ltd., can be utilized) is used as the sample for GPC. The sample is so adjusted as to have resin components in a concentration of from 0.5 to 5 mg/ml.

EXAMPLES

The present invention will be described below in greater detail by giving Examples, which, however, by no means limit the present invention. In the following formulation, "part(s)" refers to "part(s) by weight" unless particularly noted.

Example 1

In 1,000 parts by weight of ion-exchanged water, 500 parts by weight of an aqueous 0.1M $Na_3PO_4$ solution and an aqueous 1M HCl solution were introduced, the latter being in such an appropriate quantity that the pH after addition of CaCl2 came to be 4.9; followed by heating to 60° C. and then stirring at 12,000 rpm using a TK-type homomixer (manufactured by Tokushu Kika Kogyo Co., Ltd.). To the resultant mixture, 74 parts by weight of an aqueous 1.0M CaCl2 solution was added little by little to obtain an aqueous medium containing $Ca_3(PO_4)_2$. After its addition was completed, the aqueous medium was continued being stirred for 30 minutes, where its pH was measured to find that the pH was 4.9.

| | |
|---|---|
| Styrene | 160 parts |
| n-Butyl acrylate | 40 parts |
| Saturated polyester resin (bisphenol A modified with propylene oxide was used as an alcohol component, and terephthalic acid as an acid component) (Mw: 10,000; acid value: 10 mg · KOH/g) | 10 parts |
| Carbon black | 16 parts |
| Di-tert-butylsalicylic acid aluminum compound, Exemplary Compound (1) | 2 parts |
| Di-tert-butylsalicylic acid | 0.5 part |
| Divinylbenzene | 0.4 part |
| Paraffin wax (m.p.: 70° C.) | 30 parts |

Meanwhile, the above materials were heated to 60° C., and dissolved and dispersed uniformly at 12,000 rpm by means of a TK-type homomixer (manufactured by Tokushu Kika Kogyo Co., Ltd.). In the mixture obtained, 10 parts of a polymerization initiator 2,2'-azobis(2,4-dimethylvaleronitrile) was dissolved. Thus, a polymerizable monomer composition was prepared.

The polymerizable monomer composition thus obtained was introduced into the above aqueous medium, followed by stirring at 10,000 rpm for 10 minutes at 60° C. in an atmosphere of nitrogen by means of the TK-type homomixer, to carry out granulation of the polymerizable monomer composition. Thereafter, the granulated product obtained was stirred with a paddle mixing blade during which the temperature was raised to 80° C. to carry out reaction for 10 hours. After the polymerization reaction was completed, the residual monomers were evaporated under reduced pressure, the reaction product was cooled, and thereafter hydrochloric acid was added to dissolve the calcium phosphate, followed by filtration, washing with water and drying to obtain polymer particles having a very sharp particle size distribution of D1=6.1 μm, D4=7.2 μm and D4/D1=1.18. In this polymer particles, fine particles with 2 μm or smaller diameter were held by 9%.

To 98.5 parts of the particles thus obtained, 1.5 parts by weight of hydrophobic silica having a specific surface area of 200 $m^2/g$ as measured by the BET method was added externally to obtain toner A. To 5 parts by weight of this toner, 95 parts by weight of ferrite carrier coated with acrylic resin was blended to make up a developer.

Examples 2 & 3 and Comparative Examples 1 & 2

Polymer particles were produced in the same manner as in Example 1 except that the pH of the aqueous medium containing $Ca_3(PO_4)_2$ was changed as shown in Table 1. In Comparative Example 2, the adjustment of pH with the aqueous 1M HCl solution was not made. Then, in the same manner as in Example 1, hydrophobic silica was added externally to obtain toners B to E, and, to 5 parts by weight of each of these toners, 95 parts by weight of a ferrite carrier coated with acrylic resin was blended to make up developers.

Example 4

Polymer particles were produced in the same manner as in Example 1 except that the di-tert-butylsalicylic acid aluminum compound used therein was replaced with a 2-hydroxynaphthalene-3-carboxylic acid aluminum compound and the di-tert-butylsalicylic acid was replaced with 2-hydroxynaphthalene-3-carboxylic acid. Then, in the same manner as in Example 1, hydrophobic silica was added externally to obtain toner F, and, to 5 parts by weight of this toner, 95 parts by weight of a ferrite carrier coated with acrylic resin was blended to make up a developer.

Examples 5 & 6 and Comparative Examples 3 & 4

Polymer particles were produced in the same manner as in Example 4 except that the pH of the aqueous medium containing $Ca_3(PO_4)_2$ was changed as shown in Table 1. In Comparative Example 4, the adjustment of pH with the aqueous 1M HCl solution was not made. Then, in the same manner as in Example 1, hydrophobic silica was added externally to obtain toners G to J, and, to 5 parts by weight of each of these toners, 95 parts by weight of a ferrite carrier coated with acrylic resin was blended to make up developers.

Example 7

Polymer particles were produced in the same manner as in Example 1 except that the colorant carbon black used therein was replaced with a copper phthalocyanine pigment. Then, in the same manner as in Example 1, hydrophobic silica was added externally to obtain toner K, and, to 5 parts by weight of this toner, 95 parts by weight of a ferrite carrier coated with acrylic resin was blended to make up a developer.

Examples 8 & 9 and Comparative Examples 5 & 6

Polymer particles were produced in the same manner as in Example 6 except that the pH of the aqueous medium containing $Ca_3(PO_4)_2$ was changed as shown in Table 1. In Comparative Example 6, the adjustment of pH with the aqueous 1M HCl solution was not made. Then, in the same manner as in Example 1, hydrophobic silica was added externally to obtain toners L to O, and, to 5 parts by weight of each of these toners, 95 parts by weight of a ferrite carrier coated with acrylic resin was blended to make up developers.

Example 10

Polymer particles were produced in the same manner as in Example 1 except that the di-tert-butylsalicylic acid used therein was replaced with naphthoic acid. Then, in the same manner as in Example 1, hydrophobic silica was added externally to obtain toner P, and, to 5 parts by weight of this toner, 95 parts by weight of a ferrite carrier coated with acrylic resin was blended to make up a developer.

Examples 11 & 12 and Comparative Examples 7 & 8

Polymer particles were produced in the same manner as in Example 10 except that the pH of the aqueous medium containing $Ca_3(PO_4)_2$ was changed as shown in Table 1. In Comparative Example 8, the adjustment of pH with the aqueous 1M HCl solution was not made. Then, in the same manner as in Example 1, hydrophobic silica was added externally to obtain toners Q to T, and, to 5 parts by weight of each of these toners, 95 parts by weight of a ferrite carrier coated with acrylic resin was blended to make up developers.

Using the toners produced in the above Examples and Comparative Examples, evaluation tests were made in the following way to obtain the results of evaluation as shown in Table 1. In each evaluation test, a full-color copying machine CLC-700, manufactured by CANON INC., was used.

Evaluation was made on items (1) transfer efficiency, (2) changes in charge quantity at the initial stage and after 50,000-sheet running, (3) carrier contamination during such running and (4) charging rise performance at the time of 1,000-sheet copying in an environment of low temperature and low humidity and an environment of high temperature and high humidity.

(1) Transfer efficiency:

To measure transfer efficiency, toner images (image density: 1.4) formed on the photosensitive drum are collected with a transparent pressure-sensitive adhesive tape, and their image density (D1) is measured with a Macbeth densitometer or a color reflection densitometer (e.g., Color Reflection Densitometer X-RITE 404A, manufactured by X-Rite Co.). Next, toner images are again formed on the photosensitive drum, and the toner images are transferred to a recording medium. The toner images transferred onto the recording medium are collected with a transparent pressure-sensitive adhesive tape, and their image density (D2) is measured similarly. From the image densities (D1) and (D2) obtained, the transfer efficiency is calculated as shown below.

$$\text{Transfer efficiency } (\%) = (D2/D1) \times 100$$

(2) Changes in charge quantity:

To measure the changes in charge quantity, copying tests are made in an environment of normal temperature and normal humidity (23° C./60% RH; N/N). Charge quantity of the developer is measured at the initial stage and after copying is completed on 50,000 sheets, and evaluation is made in accordance with the difference between them. To measure the charge quantity (quantity of triboelectricity), a device shown in FIGURE is used.

The developer on which the quantity of triboelectricity is to be measured is put in a bottle with a volume of 50 to 100 ml, made of polyethylene, and shaked manually for 5 to 10 minutes. Thereafter, about 0.5 to 1.5 g of the developer is put in a measuring container 2 made of a metal at the bottom of which a screen 3 of 500 meshes is provided, and the container is covered with a plate 4 made of a metal. The total weight of the measuring container 2 at this time is weighed and is expressed as W1 (g). Next, in a suction device 1 (made of an insulating material at least at the part coming into contact with the measuring container 2), air is sucked from a suction opening 7 and an air-flow control valve 6 is operated to control the pressure indicated by a vacuum indicator 5, to be 250 mmAq. In this state, suction is carried out well, preferably for 2 minute, to remove the toner by suction. The potential indicated by a potentiometer 9 at this time is expressed as V (volt). Herein, reference numeral 8 denotes a capacitor, whose capacitance is expressed as C ($\mu$F). The weight of the whole measuring container after completion of the suction is also weighed and is expressed as W2 (g). The quantity of triboelectricity ($\mu$C/g) of toner is calculated as shown by the following expression.

$$\text{Quantity of triboelectricity } (\mu C/g) \text{ of toner} = (C \times V)/(W1 - W2)$$

Evaluation is made by the breadth of change in charge quantity between the initial stage and after the copying completed on 50,000 sheets, the breadth being indicated by "%" on the basis of the initial-stage charge quantity. In practical use, "C" or above ranks are desirable.

A: From 0 to 10%.
B: From 11 to 20%.
C: From 21 to 30%.
D: From 31 to 40%.
E: From 41 to 50%.
F: 51% or more.

(3) Carrier contamination:

As to carrier contamination, the surfaces of carrier particles are observed on an electron microscope after running on 50,000 sheets in an environment of normal temperature and normal humidity (23° C./60%RH; N/N), and the degree of contamination is examined to make evaluation. In practical use, "B" or above ranks are desirable.

A: No contamination has occurred.
B: Contamination has occurred slightly.
C: Contamination has occurred.
D: Contamination has occurred greatly.

(4) Charging rise performance:

With regard to the charging rise performance, image reproduction is tested in an environment of low temperature and low humidity (15° C./5%RH; L/L) and an environment of high temperature and high humidity (30° C./80%RH; H/H), and fog on copy paper at the running initial stage (1,000 sheet) is measured to make evaluation.

The fog on paper is measured with a reflection densitometer REFLECTOMETER MODEL TC-6DS, manufactured by Tokyo Denshoku Co., Ltd.). The worst white-background reflection density after print is indicated as Ds and an average value of reflection densities of paper before printing as Dr, where the difference of Ds−Dr is regarded as the amount of fog on paper.

Images with fog of 3% or less are good images free of fog on paper, and those with fog of more than 5% are unsharp images having fog a little conspicuously.

A: From 0 to 3%.
B: From 3 to 5%.
C: From 6 to 9%.
D: 10% or more.

TABLE 1

| Toner | Adjustment of pH by adding HCl | pH after 30-minute stirring | D1 ($\mu$m) | D4 ($\mu$m) | D4/D1 | 2 $\mu$m or smaller particles (%) | Transfer efficiency (%) | (1) | (2) | (3) | (4) | Remarks |
|---|---|---|---|---|---|---|---|---|---|---|---|---|
| Example: | | | | | | | | | | | | |
| 1 A | Yes | 4.9 | 6.1 | 7.2 | 1.18 | 9 | 98 | A | A | A | A | |
| 2 B | Yes | 6.8 | 5.0 | 6.2 | 1.24 | 12 | 97 | B | B | A | A | |
| 3 C | Yes | 5.8 | 5.6 | 6.8 | 1.21 | 10 | 97 | A | B | A | A | |
| Comparative Example: | | | | | | | | | | | | |
| 1 D | Yes | 3.8 | 5.4 | 9.0 | 1.67 | 10 | 94 | B | B | A | A | *1 |
| 2 E | No | 9.7 | 5.2 | 7.1 | 1.37 | 21 | 92 | D | E | B | B | |
| Example: | | | | | | | | | | | | |
| 4 F | Yes | 6.8 | 5.0 | 6.3 | 1.26 | 13 | 96 | B | C | A | A | |
| 5 G | Yes | 5.8 | 5.5 | 6.7 | 1.22 | 11 | 97 | A | A | A | A | |
| 6 H | Yes | 4.9 | 6.0 | 7.2 | 1.20 | 10 | 98 | A | A | A | A | |
| Comparative Example: | | | | | | | | | | | | |
| 3 I | Yes | 3.8 | 5.6 | 9.6 | 1.71 | 12 | 94 | B | B | A | A | *1 |
| 4 J | No | 9.7 | 5.3 | 7.3 | 1.38 | 22 | 92 | D | E | B | B | |
| Example: | | | | | | | | | | | | |
| 7 K | Yes | 6.8 | 5.1 | 6.4 | 1.25 | 16 | 96 | B | C | A | A | |
| 8 L | Yes | 5.8 | 5.6 | 6.9 | 1.23 | 13 | 97 | A | B | A | A | |
| 9 M | Yes | 4.9 | 6.0 | 7.3 | 1.22 | 12 | 98 | A | A | A | A | |
| Comparative Example: | | | | | | | | | | | | |
| 5 N | Yes | 3.8 | 5.6 | 10.1 | 1.80 | 14 | 91 | B | B | A | A | *1 |
| 6 O | No | 9.7 | 5.3 | 7.4 | 1.40 | 30 | 94 | D | E | B | B | |
| Example: | | | | | | | | | | | | |
| 10 P | Yes | 6.8 | 5.0 | 6.6 | 1.32 | 19 | 96 | C | C | B | B | |
| 11 Q | Yes | 5.8 | 5.4 | 7.0 | 1.30 | 18 | 96 | B | C | B | B | |
| 12 R | Yes | 4.9 | 5.7 | 7.4 | 1.30 | 17 | 97 | B | B | B | B | |
| Comparative Example: | | | | | | | | | | | | |
| 7 S | Yes | 3.8 | 6.1 | 12.1 | 1.80 | 12 | 91 | D | D | B | C | *2 |
| 8 T | No | 9.7 | 5.5 | 8.0 | 1.45 | 37 | 92 | E | F | C | C | |

(1): Changes of charge quantity in N/N;
(2): Carrier contamination after 50,000 sheet running in N/N;
(3): Charging rise performance in L/L;
(4): Charging rise performance in H/H

What is claimed is:

1. A process for producing a toner for developing an electrostatic latent image; the process comprising the steps of;

dispersing in an aqueous medium having a pH of from 4.5 to 8.5 a polymerizable monomer composition containing at least a polymerizable vinyl monomer, a colorant, an organic metal compound, an aromatic carboxylic acid, a polyester resin having an acid value of from 5 mg·KOH/g to 50 mg·KOH/g, and a polymerization initiator, to form particles of the polymerizable monomer composition in the aqueous medium; and polymerizing the polymerizable vinyl monomer in the particles of the polymerizable monomer composition.

2. The process according to claim 1, wherein said polyester resin has an acid value of from 5 mg·KOH/g to 35 mg·KOH/g.

3. The process according to claim 1, wherein said polyester resin is a polyester resin having a weight-average molecular weight of from 5,000 to 50,000.

4. The process according to claim 1, wherein said polyester resin is a polyester resin having a weight-average molecular weight of from 5,000 to 35,000.

5. The process according to claim 1, wherein said polyester resin is a polyester resin having a weight-average molecular weight of from 5,000 to 50,000 and an acid value of from 5 mg·KOH/g to 35 mg·KOH/g.

6. The process according to claim 1, wherein said polyester resin is a polyester resin having a weight-average molecular weight of from 5,000 to 35,000 and an acid value of from 5 mg·KOH/g to 35 mg·KOH/g.

7. The process according to claim 1, wherein said polymerizable vinyl monomer is a monomer selected from the group consisting of a styrene monomer, an acrylate monomer and a methacrylate monomer.

8. The process according to claim 1, wherein said organic metal compound is a metal compound of an aromatic hydroxycarboxylic acid.

9. The process according to claim 1, wherein said organic metal compound is a metal compound of an aromatic hydroxycarboxylic acid; the metal contained being a metal selected from the group consisting of aluminum, zinc, chromium, cobalt, nickel, copper and iron.

10. The process according to claim 1, wherein said aromatic carboxylic acid is an aromatic hydroxycarboxylic acid.

11. The process according to claim 1, wherein said aromatic carboxylic acid is salicylic acid or an alkylsalicylic acid having an alkyl group having 5 or less carbon atoms.

12. The process according to claim 1, wherein said aromatic carboxylic acid is a 3,5-dialkylsalicylic acid.

13. The process according to claim 1, wherein said aromatic carboxylic acid is a 3,5-di-t-butylsalicylic acid.

14. The process according to claim 1, wherein said polymerizable monomer composition contains a wax.

15. The process according to claim 1, wherein said polymerizable monomer composition contains a wax in an amount of from 3 parts by weight to 20 parts by weight based on 100 parts by weight of the polymerizable monomer.

16. The process according to claim 1, wherein said polymerizable monomer composition contains the colorant in an amount of from 1 part by weight to 20 parts by weight based on 100 parts by weight of the polymerizable monomer.

17. The process according to claim 1, wherein said polymerizable monomer composition contains the organic metal compound in an amount of from 0.45 part by weight to 13.5 parts by weight based on 100 parts by weight of the polymerizable monomer.

18. The process according to claim 1, wherein said polymerizable monomer composition contains the aromatic carboxylic acid in an amount of from 0.01 part by weight to 1.5 parts by weight based on 100 parts by weight of the polymerizable monomer.

19. The process according to claim l, wherein said polymerizable monomer composition contains the polyester resin in an amount of from 0.1% by weight to 15% by weight based on the weight of the polymerizable monomer.

20. The process according to claim 1, wherein said aqueous medium has a pH of from 4.5 to 7.0 before the polymerizable monomer composition is dispersed.

21. The process according to claim 1, wherein said aqueous medium contains a dispersion stabilizer before the polymerizable monomer composition is dispersed, and is adjusted to have a pH of from 4.5 to 7.0 by adding an acid.

* * * * *

UNITED STATES PATENT AND TRADEMARK OFFICE

CERTIFICATE OF CORRECTION

PATENT NO. : 5,989,770

DATED : November 23, 1999

INVENTOR(S) : TOSHIYUKI UGAI ET AL.

It is certified that error appears in the above-identified patent and that said Letters Patent is hereby corrected as shown below:

COLUMN 2

Line 57, "tones" should read --toners--.

COLUMN 9

Line 1, "it encapsulate." should read --such that it encapsulates--.

COLUMN 10

Line 27, "a" should be deleted;
Line 34, "an" should be deleted; and
Line 35, "polymer" should read --polymers--.

UNITED STATES PATENT AND TRADEMARK OFFICE

CERTIFICATE OF CORRECTION

PATENT NO. : 5,989,770

DATED : November 23, 1999

INVENTOR(S) : TOSHIYUKI UGAI ET AL.

It is certified that error appears in the above-identified patent and that said Letters Patent is hereby corrected as shown below:

COLUMN 14

Line 35, "anti-cakinging" should read --anti-caking--.

COLUMN 17

Line 58, "matters" should read --matter--.

COLUMN 18

Line 12, "CaCl2" should read --$CaCl_2$--; and
Line 16, "CaCl2" should read --$CaCl_2$--.

UNITED STATES PATENT AND TRADEMARK OFFICE

CERTIFICATE OF CORRECTION

PATENT NO. : 5,989,770

DATED : November 23, 1999

INVENTOR(S) : TOSHIYUKI UGAI ET AL. Page 3 of 3

It is certified that error appears in the above-identified patent and that said Letters Patent is hereby corrected as shown below:

COLUMN 22

Line 23, "more." should read --more.
¶In Table 1, The column of "Remarks";
¶*1: Agglomeration was seen to occur partly.
¶*2: Agglomeration and coalescence were seen to occur.--

Signed and Sealed this

Twenty-third Day of January, 2001

*Attest:*

Q. TODD DICKINSON

*Attesting Officer*

*Commissioner of Patents and Trademarks*